US005115654A

United States Patent [19]

Swars et al.

[11] Patent Number: 5,115,654

[45] Date of Patent: May 26, 1992

[54] EXPANSION APPARATUS HAVING THREE BOREHOLE-CHANNEL SYSTEMS

[75] Inventors: Helmut Swars; Wolfgang Maus, both of Bergisch Gladbach, Fed. Rep. of Germany

[73] Assignee: Emitec Gesellschaft für Emissionstechnologie mbH, Lohmar, Fed. Rep. of Germany

[21] Appl. No.: 452,617

[22] Filed: Dec. 18, 1989

[30] Foreign Application Priority Data

Dec. 17, 1988 [DE] Fed. Rep. of Germany ..... 3842589

[51] Int. Cl.[5] ..... B21D 26/02

[52] U.S. Cl. ..... 72/62; 72/61; 29/283.5; 29/421.1; 29/523

[58] Field of Search ..... 29/252, 283.5, 421.1, 29/464, 506, 507, 508, 516, 522.1, 523; 72/58, 61, 62

[56] References Cited

U.S. PATENT DOCUMENTS

| | | | |
|---|---|---|---|
| 3,030,901 | 4/1962 | McConnell | 72/62 X |
| 4,944,173 | 7/1990 | Swars | 72/62 |

FOREIGN PATENT DOCUMENTS

| | | | |
|---|---|---|---|
| 372608 | 2/1988 | Fed. Rep. of Germany . | |
| 54-77272 | 6/1979 | Japan | 72/58 |
| 8700457 | 1/1987 | PCT Int'l Appl. | 72/62 |
| 2206515 | 1/1989 | United Kingdom | 29/283.5 |
| 2207071 | 1/1989 | United Kingdom | 29/283.5 |

*Primary Examiner*—Joseph M. Gorski
*Assistant Examiner*—Peter Dungba Vo
*Attorney, Agent, or Firm*—Toren, McGeady & Associates

[57] ABSTRACT

A process for allowing the attachment of drive or coupling elements, such as cams, gears, crank webs or bearing elements, such as friction bearing bushes, or complete roller bearings on tubes or tubular portions by hydraulic expansion, for the purpose of producing assembled cam shafts, transmission shafts, crank shafts or the like, with the expansion of the tubes taking place exclusively in the region of the respective elements beyond the limit of elasticity of the tubes, against a permanent elastic prestress in the elements. To relieve the load on the seals limiting the regions to be expanded, a counter pressure which is higher than the ambient pressure is applied to the intermediate or end regions.

1 Claim, 1 Drawing Sheet

EXPANSION APPARATUS HAVING THREE BOREHOLE-CHANNEL SYSTEMS

BACKGROUND OF THE INVENTION

The invention relates to a process for allowing the attachment of drive or coupling elements, such as cams, gears, crank webs, or bearing elements, such as friction bearing bushes or complete roller bearings, on tubes or tubular portions, by hydraulic expansion of the tube in the region of the respective element beyond the limit of elasticity against an elastic prestress prevailing in the respective elements. The hydraulic expansion is accomplished by means of a pressure agent probe comprising effective portions which are associated with the respective elements to be attached, which are limited by seals and which, via a first probe borehole system, are connected to a pressure agent generator. The pressure agent probe also has intermediate portions between the individual effective portions, which are in contact with a second probe borehole system, and end portions adjoining the respective outermost effective portions. The effective portions form effective regions with the tube, the intermediate portions form intermediate regions with the tube and the end portions form end regions with the tube.

From DE 37 26 083 A1 (Balcke-Dürr) a pressure agent probe is known which comprises two independent borehole systems the first of which, for pressurizing the effective regions, is connected to a pressure agent generator, and the second system, by being connected to the intermediate portions, serves to drain off any leakages, especially when some of the seals fail. The process which may be carried out with these means is characterized by the pressure build-up in the effective regions up to a point where the limit of elasticity of the tubular portions concerned is exceeded, and the subsequent pressure decreases. Accordingly, the pressure generator comprises an exit which is directly connected to the first borehole system of the pressure agent probe.

The essential problem of the prior art processes relates to the lack of operating safety of the seals, especially with increasingly larger shaft types to be produced by this process the necessary pressures increase further.

SUMMARY OF THE INVENTION

Accordingly, it is an object of the present invention to provide a process which reduces the risk of seal failure and improves the service life of the seals.

It is a further object of the invention to provide a pressure agent probe suitable for carrying out the inventive process, as well as a suitable pressure generator for carrying out the process, which may be connected to such a probe.

Pursuant to this object, and others which will become apparent hereafter, one aspect of present invention resides in subjecting the effective regions to a high effective pressure suitable for deforming the tube beyond its limit of elasticity. The intermediate regions and the end regions, at least in the portions on both sides of the effective regions and at least while the high effective pressure is maintained, are subjected to a lower counter pressure which is higher than the ambient pressure and lower than the pressure required for deforming the tube beyond its limit of elasticity. This process in accordance with the invention allows considerably higher effective pressures to be generated without having to modify basically the type of seals used, as a rule standard annular seals, since their failure and wear is primarily determined by the pressure differential to be sealed, whereas they are relatively insensitive to an increase in the absolute pressure level.

By generating, in accordance with the invention, a counter pressure outside the effective regions which in no way, permanently, adversely affects the properties of the tubular member exposed in this region, the seals are prevented from entering to an excessive extent the sealing gap, as a result of which the service life of the seals is increased considerably and simultaneously it becomes possible to increase the pressure further. It is particularly important to apply the counter pressure to the seals during the reduction in pressure after the tube expansion, because during this phase there is a risk of the seal being partially caught in the sealing gap and being damaged mechanically while the member agent probe is pulled out of the tubular member.

When using a standard pressure agent generator which builds up the pressure in an uncontrolled way, it is proposed that, for the purpose of building up the pressure, a prepressure which is lower than the effective pressure is initially built up for sealing the seals in the effective region. This is then followed by a further pressure build-up in the effective regions and by a build-up of counter pressure in the intermediate regions and end regions, with the pressure in the effective regions always being higher than that in the intermediate and end regions, until the required counter pressure level has been achieved, with the pressure differential having to remain below the design limit of the seals. Thereafter, a further pressure build-up takes place in the effective regions until the required effective pressure level is reached, with the higher pressure in the effective regions always ensuring contact of the seals. For the purpose of reducing the pressure after building up and maintaining the effective pressure, first, the pressure in the effective region is reduced to an intermediate pressure level which is lower than that of the counter pressure in order to relieve the load on, and allow a spring-back of, the seals. Thereafter, the pressure in the effective region and the counter pressure in the intermediate and end regions are reduced jointly.

Depending on the design of the pressure agent probe, the volumes of the intermediate and end regions connected to the second borehole system are relatively large, so that in a further advantageous embodiment of the process the spaces are filled first with a low filling pressure whose level is below that of the counter pressure. This presupposes the existence of a pressure agent generator with suitable control facilities. In a further embodiment, the process stage analogously applies to filling the effective region prior to applying the effective pressure. Depending on the behavior of the seals, the filling pressure should be set in such a way that it moves the seals into sealing contact with the tube so that during the subsequent application of the effective and counter pressures no uncontrolled deformation of the seals occurs.

The pressure reduction in the effective region on the one hand and in the end and intermediate regions on the other hand should preferably take place in a reverse sequence to that of the pressure build-up, and again the objective has to be to keep the pressure differentials at the seals as low as possible and to achieve a seal release by means of a reversed pressure differential.

In an another embodiment of the invention, the above-mentioned filling pressure is applied even during the insertion of the pressure agent probe and while the probe is pulled out of the tubular member so that fluid flushes the seals at a low pressure. This results in a desirable friction-reducing lubricating effect for the seals relative to the rough inner wall of the tubular member.

A pressure agent probe in accordance with the invention for carrying out the above-mentioned process is characterized in that outside the outer effective portions limited by seals there are arranged, at a distance, further seals for forming pressure-loaded end portions. The end portions are connected to the same system of longitudinal channels and radial boreholes connected thereto as the intermediate portions and both borehole systems may be separately connected to the pressure generating means. Such a pressure agent probe makes it possible, as explained above, to generate the required counter pressure in the intermediate and end regions prior to, or while, applying the effective pressure in the effective regions.

In a further embodiment of a pressure agent probe in accordance with the invention the seal pairs of the effective portions are framed on both sides by at least one counter pressure portion limited by seals arranged in pairs. The counter pressure portions are connected in pairs to the second system of longitudinal channels and radial bores and both borehole systems may be separately sealingly connected to pressure agent means. In this way, in accordance with the invention, each effective portion is associated with separate adjoining portions to which a counter pressure is applied. Depending on the probe design this arrangement may be advantageous because it permits the volumes to be subjected to the counter pressure to be kept very much smaller. The need for a larger number of seals is thus reduced. This design is advantageous for probes with particularly pronounced sealing portions with a larger diameter.

The above-mentioned basic probe designs may be advantageously combined in such a way as to provide a third borehole system of longitudinal channels and radial boreholes, with the three existing systems then being subjected to different pressure levels each, thereby permitting a double-stage pressure differential for applying particularly high pressures in the effective regions. The intermediate pressure regions directly adjoining the effective regions may be kept short enough for them to be still within the elements to be attached, and the pressure acting within them deforms the tube beyond its limit of elasticity.

Pressure generators in accordance with the invention for carrying out the process in accordance with the invention and for being connected to the pressure agent probes are characterized in that one single working or pressure converting piston, in the course of one operating stroke, loads at least two pressure agent exits with different pressures. The working piston especially being designed as a differential piston and by connecting certain dead spaces the different pressure curves required are generated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF PREFERRED EMBODIMENTS

Figures 1, 2, 3:
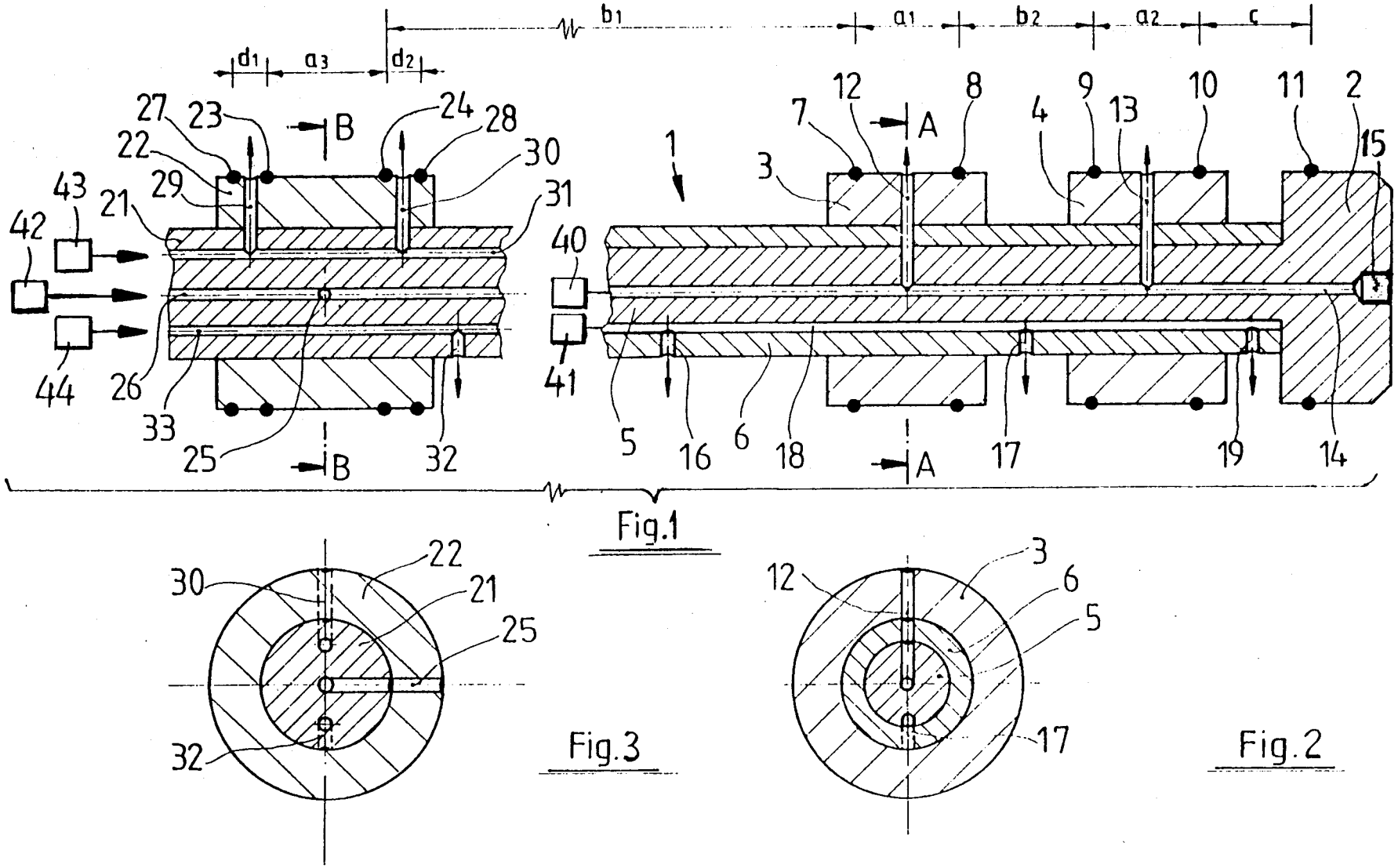
FIG. 1 shows a longitudinal section and cross section of a pressure agent probe pursuant to the present invention with two borehole systems.
FIG. 2 illustrates a longitudinal section and cross section of a pressure agent probe pursuant to the present invention with three borehole systems.

FIG. 1 shows a basic probe member 1 which ends in a probe head 2 and onto which there have been slid two sleeves 3, 4 which are connected to the basic member 1 by soldering, for example. The basic member 1 consists of an inner tube 5 integral with the probe head and an outer tube 6. Seal pairs 7, 8 and 9, 10 define effective regions $a_1$, $a_2$ on the sleeves.

Between the effective regions there is an intermediate region $b_2$. The probe head 2 is provided with a further seal 11 which, together with the seal 10, defines an end region c. Via radial boreholes 12, 13, the effective regions are connected to a central pressure agent guiding borehole 14 in the basic probe member 1 which penetrates the latter completely and is closed in the probe head 2 by a plug 15. Via radial boreholes 16, 17, the intermediate regions $b_1$, $b_2$ are connected to a longitudinal channel 18 designed as a groove in the inner tube 5. Via a further radial borehole 19 the end region c is connected to this same longitudinal channel 18 whose end is closed by the probe head 2. This second borehole system serves to build up the counter pressure in all the intermediate regions b and the end regions c. The central borehole 14 is connected to a higher pressure source of pressure source of pressure agent 40 to effect the expansion of the tubular member in the effective regions $a_1$, $a_2$, etc., and the channel 18 is connected to a second pressure source 41 which provides the counter pressure in the regions b and c.

In FIG. 2, a sleeve 22 has been slid onto a basic probe member 21 in a way so as to be integral with it, which sleeve 22 may be connected with the tubular member by gluing, shrinking or soldering, for example. The sleeve 22 carries seals 23, 24 which are arranged in pairs and define an effective region $a_3$. The effective region $a_3$ is connected to a central pressure agent channel 26 via a radial borehole 25 which extends vertically relative to the drawing. The channel 16 is connected to a high pressure source 42 of pressure agent. Further seals 27, 28 directly adjoin the seals 23, 24 on the sleeve 22, and define the above-mentioned counter or intermediate pressure portions $d_1$, $d_2$. Via radial boreholes 29, 30, the intermediate pressure portions $d_1$, $d_2$ are connected to a longitudinal channel 31 in the basic probe member 21 via which a counter pressure has to be applied from a pressure source 43 if no further boreholes have been provided in the probe. An intermediate pressure from a pressure source 44 is applied if the probe has a third system of radial boreholes 32 which, via a third longitudinal channel 33 are loaded with a counter pressure for the intermediate and end regions.

While the invention has been illustrated and described as embodied in a process for allowing attachment of elements on tubes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. An apparatus for radially expanding a tubular member, comprising:

an elongated pressure agent probe having separate first, second and third internal channels each having an open end and a closed end and extending longitudinally of the probe;

first, second and third radial boreholes extending from the first, second and third internal channels, respectively, to an external surface of the probe;

a plurality of circumferential seals mounted on said external surface in longitudinally spaced relation, each of said first boreholes opening into said external surface between an adjacent pair of seals which define between them an effective region for expansion of said tubular member, each said second boreholes opening into said external surface at first intermediate regions immediately adjacent to and on each side of said effective regions, each first intermediate region being defined between one of the seals which defines its adjacent effective region and another seal which does not define an effective region, said third boreholes opening into said external surface in second intermediate regions each defined between said other seals which are arranged successively longitudinally of the probe and in end regions defined between said ends of the probe and said other seals of the first intermediate regions adjacent to said ends;

a first, higher pressure source of pressure agent connected to the open end of said first channel; and a second lower pressure source and a third lower pressure source of pressure agent connected to the open ends of said second and third channels, respectively.

* * * * *